US006929111B2

(12) United States Patent
Rovers

(10) Patent No.: US 6,929,111 B2
(45) Date of Patent: Aug. 16, 2005

(54) APPARATUS AND A METHOD FOR COLLATING AND CARTONNING PRODUCT UNITS

(75) Inventor: Theodorus Johannes Gerardus Maria Rovers, Ledeacker (NL)

(73) Assignee: Langenpac NV, Wijchen (NL)

( * ) Notice: Subject to any disclaimer, the term of this patent is extended or adjusted under 35 U.S.C. 154(b) by 10 days.

(21) Appl. No.: 10/275,352

(22) PCT Filed: May 4, 2001

(86) PCT No.: PCT/IB01/00923

§ 371 (c)(1),
(2), (4) Date: Jan. 10, 2003

(87) PCT Pub. No.: WO01/85581

PCT Pub. Date: Nov. 15, 2001

(65) Prior Publication Data

US 2004/0225406 A1 Nov. 11, 2004

(30) Foreign Application Priority Data

May 5, 2000 (GB) ..... 0010968

(51) Int. Cl.[7] ..... B65G 47/30

(52) U.S. Cl. ..... 198/429; 198/426; 53/252; 53/473

(58) Field of Search ..... 53/252, 473; 198/426, 198/429, 430

(56) References Cited

U.S. PATENT DOCUMENTS

| | | | | |
|---|---|---|---|---|
| 2,934,869 A | * | 5/1960 | Engleson et al. | 53/57 |
| 3,608,701 A | * | 9/1971 | Dieter | 198/802 |
| 4,180,154 A | | 12/1979 | Andersson | |
| 5,176,244 A | * | 1/1993 | Radzins et al. | 198/430 |
| 5,241,806 A | * | 9/1993 | Ziegler et al. | 53/566 |
| 5,369,942 A | * | 12/1994 | Olson | 53/566 |
| 5,388,389 A | | 2/1995 | Tisma | |
| 5,657,610 A | * | 8/1997 | Dietrich et al. | 53/139.5 |
| 6,019,213 A | | 2/2000 | Schubert | |

FOREIGN PATENT DOCUMENTS

| | | |
|---|---|---|
| EP | 0 695 703 | 2/1996 |
| EP | 0 967 163 | 12/1999 |
| WO | WO-97/11014 | 3/1997 |

OTHER PUBLICATIONS

Copy of International Search Report for PCT/IB01/00923, completed Sep. 4, 2001.

* cited by examiner

*Primary Examiner*—Eileen D. Lillis
*Assistant Examiner*—Mark A. Deuble
(74) *Attorney, Agent, or Firm*—Alston & Bird LLP

(57) ABSTRACT

Apparatus for collating and cartonning product units comprising: product infeed means adapted to dispense a succession of discrete product units; one or more servo-trains, the or each servo-train comprising a plurality of buckets in which each bucket is adapted to receive a predetermined number of product units from the product infeed means to form a product group; first conveying means for conveying said one or more servo-trains between a loading station juxtaposed said product infeed means and a dispensing station; cartonning means comprising second conveying means adapted for transporting a succession of cartons juxtaposed said dispensing station; driving means associated with said first conveying means; controlling means for controlling operation of the driving means such that when a servo-train is positioned at the loading station, said servo-train is moved intermittently in synchronisation with the product infeed means for collating product units into the buckets, and after loading of the servo-train is completed by the servo-train is moved in synchronization with the second conveying means; product pushing means at the dispensing station for pushing product groups from the buckets into respective cartons on the second conveying means.

18 Claims, 2 Drawing Sheets

APPARATUS AND A METHOD FOR COLLATING AND CARTONNING PRODUCT UNITS

BACKGROUND OF THE INVENTION

1) Field of the Invention

The present invention relates to apparatus and a method for automatically collating and cartonning product units. The apparatus and method of the invention are particularly suitable for automatically collating and cartonning soft packages of product such, for example, as form, fill and seal packages. However the invention can also be applied to a wide range of other product types, packaged and unpackaged.

2) Description of Related Art

The process of providing groups of product units in respective buckets on a bucket conveyor from which the product groups are delivered into corresponding respective cartons on a cartonning line is well established within the cartonning industry. The use of servo-trains to load the bucket conveyors is also known. Typically, product units are delivered individually from an infeed into the buckets of two or more servo-trains positioned to either side of an endless bucket conveyor. The product units are then transferred group-wise from the servo-trains into a series of buckets carried on a bucket conveyor for collating the units to form product groups. The bucket conveyor then transports the product groups continuously downstream to a region in which the product groups are discharged using product pushers into a corresponding series of respective cartons.

EP 0695703 A1 (CAMA 1 SpA) discloses a servo-train conveying apparatus that is suitable for use in such a process. Said apparatus comprises two or more independently driven servo-trains that are arranged side-by-side and are adapted for movement between a loading station and an unloading station. Each servo-train comprises a plurality of cells, each of which is adapted to receive a single product unit from a product in feed. The servo-trains are loaded in turn, and when each is fully loaded it is moved off to the unloading position, where the product units are then removed from the cells and possibly diverted, individually or in multiples, to feed hoppers, conveyor chains, subsequent grouping and conveying systems (e.g. bucket conveyors), hands, robots etc., for example for final packaging in boxes, trays cartons and the like. For product units to be cartonned in groups therefore, the units may be delivered from the apparatus of EP 0695703 A1 onto a conventional bucket conveyor for collating and transport to a cartonner.

EP 0967163 A2 (Yamoto Scale Co., Ltd) discloses a boxing system comprising a boxing machine for packing groups of product units into boxes, each group comprising a predetermined number of said units, and collating means for receiving said product units from a product infeed, collating them to form said groups and conveying the groups to said boxing machine. Said collating means comprises two independently driven chain pairs that are arranged side by side and extend between a loading station and an unloading station. Each chain pair carries two sets of portions that are spaced apart along the longitudinal axis of the chain pair to define said predetermined number of cells, each cell being adapted to receive a single, respective product unit. The chain pairs are driven such that each set of portions is moved in turn with intermittent motion past the product infeed at the loading station to receive a product unit into each cell When a set is full, the chain is then driven at higher speed to move the set to the unloading station, whilst the next set on the other chain pair is loaded. At the unloading station the chain pair is paused and the group of product units is pushed from the set as one onto said boxing machine.

Said boxing machine comprises a sliding gate, on to which the group of product units is delivered and below which is positioned a box, open at its upper end and adapted to receive said group, reciprocating front, rear and opposing side holding members adapted to support and align the product units of the group, and a reciprocating pusher for pushing the group downwardly into the box upon opening the sliding gate. The box system of EP 0967163 A2 is thus adapted to collate and box product units one group at a time.

BRIEF SUMMARY OF THE INVENTION

An object of the present invention is to provide a novel system for collating product units supplied successively at an intermittent product infeed station and cartonning those product units in groups of predetermined number in cartons.

Another object of the present invention is to provide an improved process for handling such groups of product units which obviates the need for both servo-trains and a separate bucket conveyor, whilst allowing multiple groups to be handled contemporaneously.

Accordingly, it is a further object of the present invention to provide mechanical handling equipment for collating and cartonning product units that is more economic to procure and install and occupies less space than equipment used hitherto in the industry which comprises servo-trains and a separate bucket conveyor.

According to one aspect of the present invention therefore there is provided apparatus for collating and cartonning product units comprising:

product infeed means adapted to dispense a succession of discrete product units;

one or more servo-trains, the or each servo-train comprising a plurality of buckets in which each bucket is adapted to receive a predetermined number of product units from the product infeed means to form a product group;

first conveying means for conveying said one or more servo-trains between a loading station juxtaposed said product infeed means and a dispensing station;

cartonning means comprising second conveying means adapted for transporting a succession of cartons juxtaposed said dispensing station;

driving means associated with said first conveying means;

controlling means for controlling operation of the driving means such that when a servo-train is positioned at the loading station, said servo-train is moved intermittently in synchronisation with the product infeed means for collating product units into the buckets, and after loading of the servo-train is completed the servo-train is moved in synchronisation with the second conveying means;

product pushing means at the dispensing station for pushing product groups from the buckets into respective cartons on the second conveying means.

The apparatus of the invention thus obviates the requirement for servo-trains and a separate bucket conveyor by coupling the or each servo-train that is supplied by the product infeed system directly to the cartonning means. The or each servo-train is moved step-wise in integer steps past the product infeed means in synchronisation therewith so that the predetermined number of product units is delivered into each bucket, thereby to collate the product units into the buckets to form a plurality of groups. In some embodiments each bucket may be provided with a plurality of optional partitions or guides to assist in arranging the individual product units within the bucket in a suitable arrangement for subsequent cartonning. Thus, the intermittent motion of the or each servo-train may comprise a repeated sequence consisting of a predetermined number of relatively small steps corresponding to the number of product units to be placed in each bucket, followed by a single larger step to register the next succeeding bucket with the product infeed. Once a servo-train has been fully-loaded, that servo-train is then moved in synchronisation with the second conveying means past the product pushing means, which product pushing means serve to push the groups of product within the buckets into respective cartons on the second conveying means. The pushing means and cartonning means are arranged such that the groups of units are pushed from their respective buckets directly into the cartons.

Said groups of products may each comprise 2–20 units. In some embodiments each group may comprise between 2 and 12 units. Each servo-train may comprise 2–20 buckets. Typically each servo-train comprise 10–15 buckets.

In some embodiments the second conveying means may have continuous motion, and so the fully-loaded servo-train is also moved continuously at the dispensing station in synchronisation with the cartonning system. Alternatively, the second conveyor may move intermittently by advancing a predetermined number of cartons, for example 1–5 cartons, in each stroke. In such cases, the driving means is also operated to move a loaded servo-train forward in intermittent multiple-steps at the dispensing station in synchronisation with the second conveying means, such that in each stroke the servo-train is advanced by one or more buckets.

Preferably a plurality of servo-trains is provided, and said first conveying means comprise a corresponding plurality of conveyors, each conveyor being associated with a respective servo-train. Said driving means may comprise a plurality of servomotors corresponding to the number of servo-trains, and each servomotor may be associated with a respective conveyor. Said controlling means may be adapted to control operation of the servomotors such that said servo-trains are successively loaded and emptied. Thus, when one servo-train has been loaded and is moved-off for discharging the product groups into the cartons, the next empty servo-train is moved up to the product infeed means. In some preferred embodiments of the invention, two or three servo-trains and associated conveyors are provided such that the pusher means are supplied with a continuous or nearly continuous stream of full buckets.

In some embodiments, each conveyor comprises an endless belt, and said conveyors are positioned such the belts are disposed adjacent and substantially parallel to one another. Conveniently the buckets of each servo-train may be affixed to or engaged by a respective one of the belts for transport therewith, and may be supported by at least another one of the belts. The or each belt may comprise an endless chain or any other type belt known to those skilled in the art. It will be understood that a characteristic feature of a servo-train is that the buckets in the servo-train are all arranged or adapted for simultaneous motion as a single unit.

Usually said first conveying means define an endless circuit such that an empty servo-train is returned from the dispensing station to the loading station for reloading.

Various suitable product pushing means, for example pusher rods fitted at one end with a pusher plate for pushing a plurality of individual product units together into a carton, will be known to those skilled in the art. Where the second conveying means is operated continuously, pushing rods adapted to advance continuously with the servo-train are employed, for example rods fitted at the other opposing end with a cam follower adapted to run in a shaped cam track for controlling the pushing action of the pushers. In embodiments where the second conveyor is operated with a multiple-step intermittent motion, reciprocating rods that are static in the longitudinal direction of the machine may be used.

According to another aspect of the present invention there is provided a method of collating and cartonning product units comprising:

successively dispensing product units at a loading station;

conveying a servo-train comprising a plurality of buckets in which each bucket is adapted to receive a predetermined number of product units past said product loading station with intermittent motion in synchronisation with the dispensing of said product units such that said predetermined number of product units is received in each bucket to form a product group;

after loading of the servo-train is completed, conveying said servo-train to a dispensing station;

transporting a succession of cartons juxtaposed the servo-train at the dispensing station;

moving said servo-train through the dispensing station in synchronisation with said transport of the cartons; and pushing the product group from each bucket at the dispensing station into a respective carton.

As mentioned above, preferably a plurality of servo-trains is provided which are driven separately such that the servo-trains are moved successively through the loading and dispensing stations. The cartons and servo-train(s) may be moved through the dispensing station with intermittent multiple-step or continuous motion. Usually the process of the invention further comprises the step of returning the or each servo-train to the loading station after emptying for reloading.

BRIEF DESCRIPTION OF THE SEVERAL VIEWS OF THE DRAWINGS

Following is a description by way of example only with reference to the accompanying drawings of embodiments of the present invention.

In the Drawings.

DETAILED DESCRIPTION OF THE INVENTION

Figure 1:
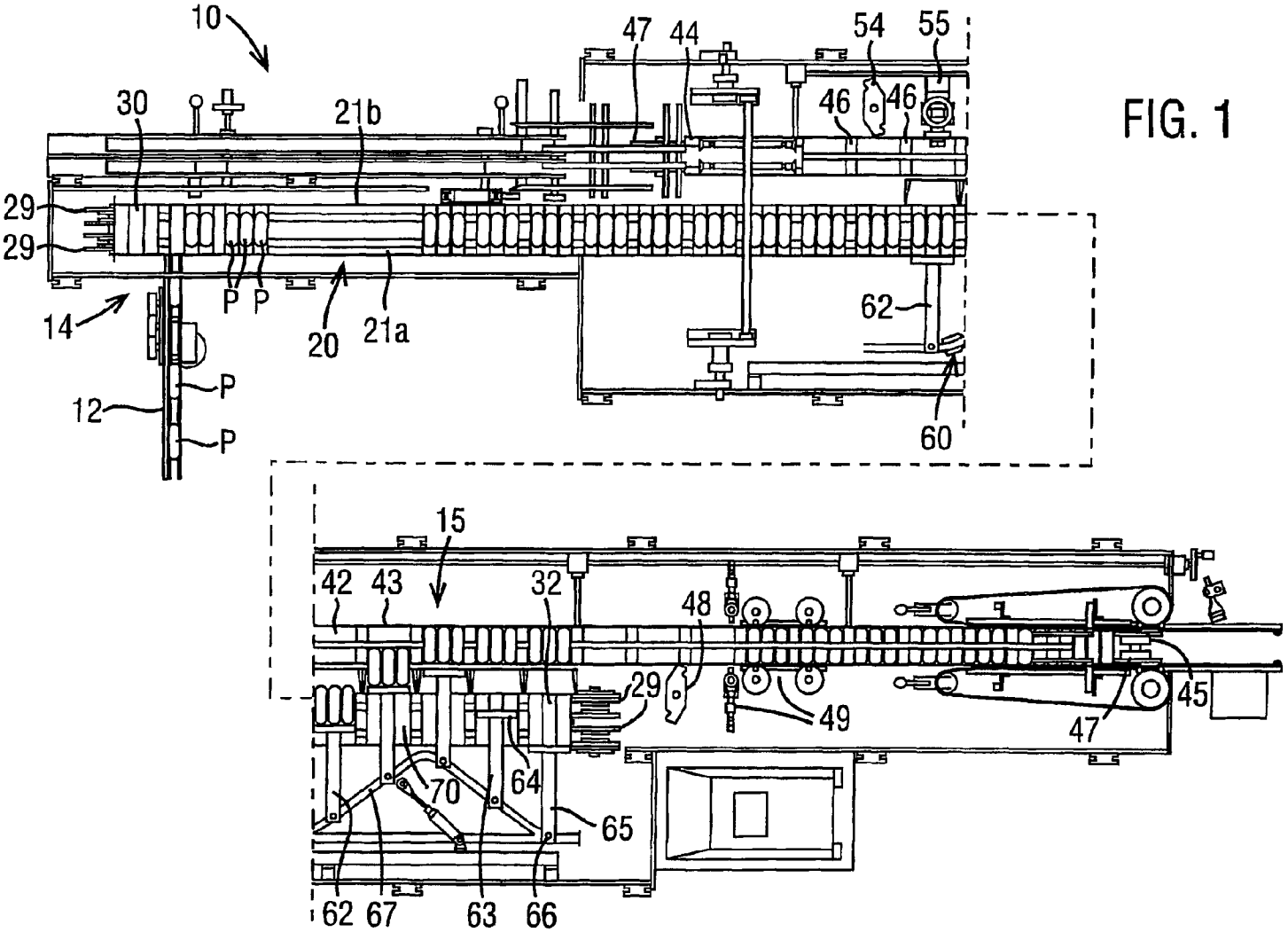
FIG. 1 is diagrammatic plan view of collating and cartonning apparatus in accordance with the present invention.
Figure 2:
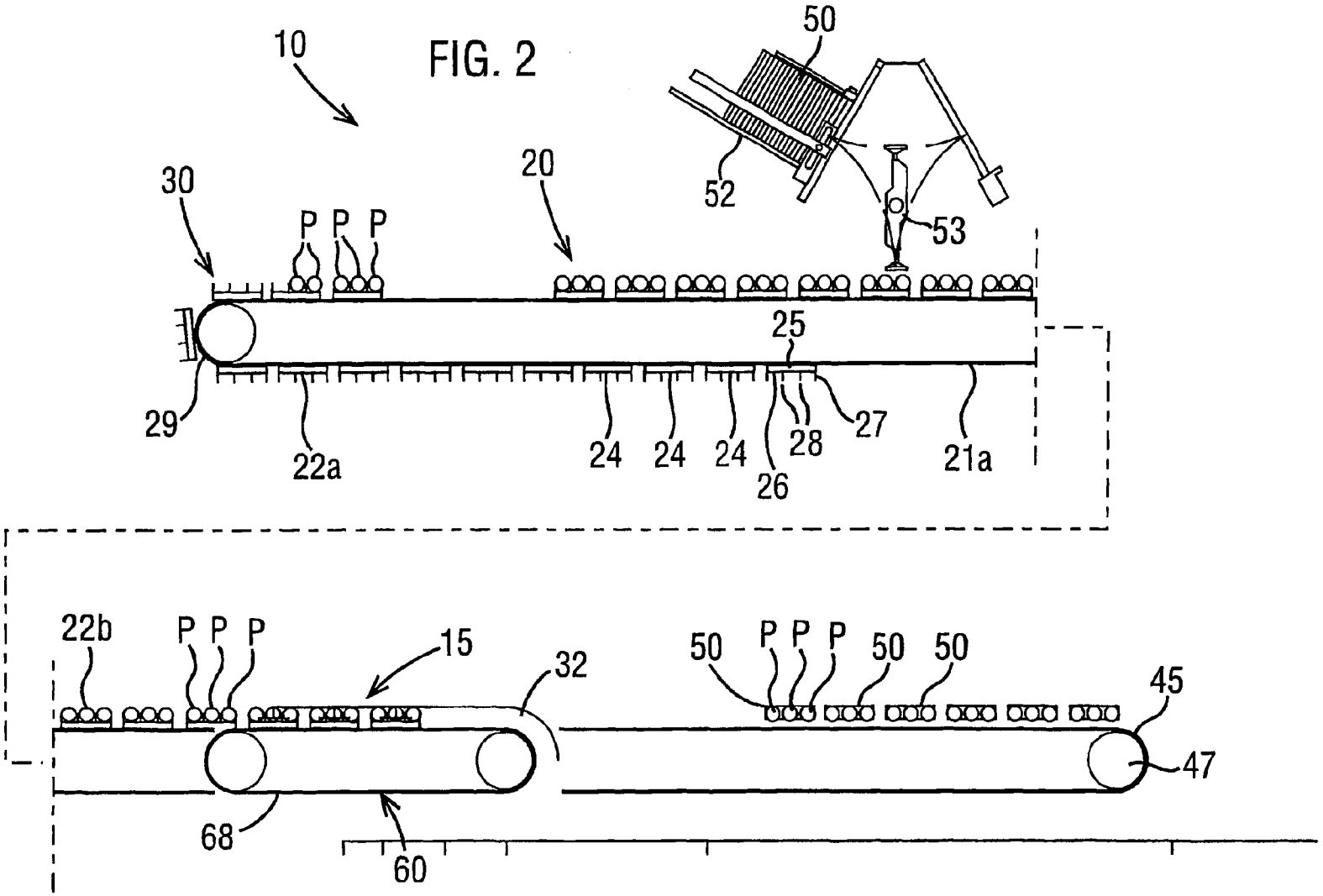
FIG. 2 is a side elevation of the apparatus of FIG. 1, partly in cross-section along the line II—II of FIG. 1.

With reference to FIGS. 1 and 2, collating and cartonning apparatus (10) in accordance with the present invention comprises a product infeed device (12) of the kind well known to those skilled in the art for dispensing a succession of product units such, for example, as individual form, fill and seal packages (p) of product at a loading station (14). Said product infeed device (12) is arranged as shown in FIG. 1 to deliver said packages to a servo-train system (20).

Said servo-train system (20) comprises two endless chains (21*a*,21*b*) that are positioned adjacent and substantially parallel to each other, with each chain being mounted in a substantially vertical plane. Each chain carries a respective servo-train (22*a*,22*b*) comprising a plurality of buckets (24) that are spaced apart along the longitudinal axis of the chain. In the embodiment illustrated in the figures, each servo-train comprises 14 buckets, but more generally, each servo-train may comprise 2–20, buckets. Each bucket, as best seen diagrammatically in FIG. 2, comprises a bottom wall (25), front and back walls (26,27) and a plurality of internal dividers (28) to divide the interior of the bucket into a plurality of compartments that are spaced longitudinally from each other between said front and back walls and are dimensioned to accommodate fairly snugly the packages dispensed by the product infeed device (12). In the embodiment shown, two dividers are provided, dividing the bucket into three compartments, but only one divider or more than two dividers may be used as required according to the number of packages to be placed in each carton. In some embodiments, each bucket may be adapted to receive as many as 50, typically 10–20, product units. The buckets have open sides, thus allowing packages (p) to be entered into and pushed out of each compartment from each side of the chain. Each bucket is affixed to its respective chain for transport therewith such that all of the buckets of each servo-train are constrained to move together as a single unit, and extends horizontally over the other chain for additional support as shown in FIG. 1.

Each chain is passed around two sprockets (29), one of which is driven by a respective servomotor (not shown) that is capable of intermittent and continuous motion.

The chains are positioned such that an upstream end (30) of the servo-train system is disposed at the loading station (14) adjacent the product infeed device, which product infeed device is arranged to deliver the packages (p) into the compartments in the buckets through the open sides thereof. The servo-trains on the two chains are positioned such that they are non-overlapping as shown in FIGS. 1 and 2, and the chains are adapted to transport the servo-trains away from the loading station towards a cartonning station (15) juxtaposed a downstream end (32) of the servo-train system.

At said cartonning station (15), a second conveyor (42) that forms part of a cartonning system (40) extends in juxtaposition substantially parallel to the chains (21*a*,21*b*). Said second conveyor (42) comprises an endless belt (43) that extends between a first end (44) of the conveyor upstream of said cartonning station (15) and a second downstream end (45) and is equipped with a plurality of transverse stretcher bars (46) that are spaced longitudinally of the second conveyor (42) at the same pitch as the buckets (24) in the two bucket chains (22*a*,22*b*). Said stretcher bars are adapted to engage a plurality of carton blanks (50) that are delivered successively onto the belt (43) from a magazine (52) at the first upstream end (44) by a carton-dispensing device (53) of known kind. Said belt passes around two pulleys (47) respectively at the first and second ends of the conveyor, one of which pulleys is driven for moving the belt (43) and the carton blanks (50) engaged thereby in the downstream direction. Intermediate the first end of the conveyor (42) and the cartonning station, said cartonning system comprises means of known kind (54,55) for erecting the cartons and for closing the front flaps of the cartons which face away from the servo-system (20).

At the cartonning station (15), a product pusher system (60) is disposed adjacent the servo-train system on the opposite side thereof to the cartonning system. Said product pusher system (60) comprises a plurality of pusher rods (62), each of which has an inner end (63) fitted with a pusher plate (64) and an outer end (65) that is equipped with a cam follower (66). Said cam followers (66) are engaged in a shaped cam track (67) and are mounted on a driven endless belt (68) at the same longitudinal pitch as the buckets (24) in the two servo-trains (22*a*,22*b*), which belt is arranged for rotation in a substantially vertical plane for driving the rods (62) along said cam track (67), thereby causing the rods (62) to reciprocate in a direction substantially transversely of the chains (21*a*,21*b*). Each of said pusher plates (64) is shaped and positioned to enter into a bucket (24) through one of the open sides thereof for pushing packages (p) out of the bucket through the opposite open side towards the second conveyor (42), and the rods (62) and cam track (67) are configured such that such contents may be delivered from the bucket into an erected carton (50) on said second conveyor (42). Suitable in-fill plates (70) are positioned between the chains (21*a*,21*b*) and the second conveyor (42) at the cartonning station (15) to allow the packages to slide from the buckets into the cartons (50) without falling between the two conveyors.

Downstream of the cartonning station (15), said cartonning system comprises the usual means (48) for closing the back flaps of the cartons that face the servo system (20) and (49) for applying hot melt, closing the outer flaps to front and back of the cartons, and holding the cartons closed whilst the adhesive sets. Thereafter the filled cartons are dispensed for storage and/or transport.

Suitable electronic control means (not shown) of the kind known to those skilled in the art are provided for controlling the operation of the servomotors associated with the chains (21*a*,21*b*) of the servo-train system, the speed of the second conveyor (42) and the speed of the pusher system (60) to provide synchronous operation of those components as described below. In operation, one of the servo-trains (22*a*, 22*b*), which is empty, is moved around the servo-train system on its respective chain (21*a*,21*b*) until the first compartment of the leading bucket (24) is aligned with the product infeed device (12) at the loading station (14). While the product infeed device is operated to dispense a succession of packages therefrom, the servomotor is operated intermittently in synchronisation with the infeed device (12) to drive the servo-train progressively downstream in a series of relatively short steps such that a single package is received in each compartment through an open side of the bucket (24). The servomotor is then operated to cause the chain (21*a*,21*b*) to move through a slightly longer step to bring the next bucket (24) into alignment with the infeed device (12). The servomotor is then operated again to provide a second series of short steps to fill the second bucket. This whole sequence is repeated until the servo-train (22*a*,22*b*) is fully loaded. The servomotor is then switched over to continuous motion to move the full servo-train downstream to the cartonning station (15). The cartonning system is operated to drive load and erect carton blanks (50) from the magazine (52) onto the second conveyor (42) as described above. The servomotor is operated such that the fully loaded servo-train (22*a*,22*b*) is moved in synchronisation with the second conveyor, with each bucket in register with a corresponding carton on the second conveyor. The product pusher system is also operated to move the push rods (62) along the cam track (67) in synchronisation with the servo-train (22*a*,22*b*), with each rod in register with a respective bucket (24). As the push rods (62) move downstream, they are caused by engagement of the cam followers (66) in the cam track (67) to move inwardly towards the servo-train (22*a*,22*b*), thereby bringing the pusher plates (64) into contact with the packages in the buckets (24) through the open sides of the buckets as shown in FIG. 1. Continued operation of the pusher system (60) causes all of the packages (p) in each bucket (24) to be pushed together out of the opposite open side directly into the corresponding carton. Thereafter, the pusher plate (64) is withdrawn as the push rod (62) continues to move along the cam track (67), and the filled carton is treated in the cartonning system (40) to close and glue the front flaps as described above.

Whilst the one fully loaded servo-train (22*a*,22*b*) is moved towards the cartonning station, and the packages (p) in that servo-train (22*a*,22*b*) are subsequently pushed into the cartons (50), the other servo-train (22*b*,22*a*) is moved continuously around the servo-train system (20) on its chain (21*b*,21*a*) to bring the leading bucket of the other servo-train (22*b*,22*a*) into register with the product infeed device (12) at the loading station (14). Thereafter the other servo-train (22*b*,22*a*) is moved intermittently as described above in relation to the one servo-train (22*a*,22*b*) until the other servo-train is fully loaded with product.

The other servo-train (22*b*,22*a*) is then moved downstream continuously for cartonning the packages (p) therein, by which time the one servo-train is completely unloaded and is moved around continuously to the start of the cycle at the loading station (14). Thereafter the cycle may be repeated endlessly.

Depending on the number of buckets in each train (22*a*, 22*b*) and the speed of the cartonner system (40), it will be appreciated by those skilled in the art that with a two chain system as described above there may be some 'dead' time after one train has been unloaded at the cartonning station (15) and before the other train has been fully loaded at the loading station (14). If desired, a third chain (not shown) may be installed adjacent and parallel to the other two chains (21*a*,21*b*) with a third servo-train in non-overlapping arrangement with the two trains (22*a*,22*b*). The provision of such an additional servo-train will serve to reduce or even eliminate any such dead time when there are no full buckets at the cartonning station (15). Those skilled in the art will understand that yet more servo chains may be used if necessary.

What is claimed is:

1. Apparatus for collating and cartonning product units comprising:

product infeed means adapted to dispense a succession of discrete product units;

one or more servo-trains, the or each servo-train comprising a plurality of buckets in which each bucket is configured to receive a predetermined plurality of product units from the product infeed means to form a product group;

first conveying means for conveying said one or more servo-trains between a loading station juxtaposed said product infeed means and a dispensing station;

cartonning means comprising second conveying means adapted for transporting a succession of cartons juxtaposed said dispensing station;

driving means associated with said first conveying means;

controlling means for controlling operation of the driving means such that when a servo-train is positioned at the loading station, said servo-train is moved intermittently in synchronization with the product infeed means for collating a product group into each of the buckets, and such that after loading of the servo-train is completed the servo-train is moved to the dispensing station and then moved in synchronisation with the second conveying means; and product pushing means at the dispensing station for pushing the product group from each bucket into a single corresponding carton on the second conveying means.

2. Apparatus as claimed in claim 1, wherein a plurality of servo-trains are provided, and said first conveying means comprises a plurality of conveyors, each conveyor being associated with at least one of the servo-trains.

3. Apparatus as claimed in claim 2, wherein said driving means comprises a plurality of servomotors corresponding to the number of servo-trains, and each servomotor is associated with a respective conveyor.

4. Apparatus as claimed in claim 3, wherein said controlling means are adapted to control operation of the servomotors such that said servo-trains are successively loaded and emptied.

5. Apparatus as claimed in claim 2, wherein two or three servo-trains and associated conveyors are provided.

6. Apparatus as claimed in claim 2, wherein each conveyor comprises an endless belt, and said conveyors are positioned such the belts are disposed adjacent and substantially parallel to one another.

7. Apparatus as claimed in claim 6, wherein the buckets of each servo-train are affixed to a respective one of the belts for transport therewith, and are supported by at least another one of the belts.

8. Apparatus as claimed in claim 1, wherein said first conveying means comprise an endless loop such that an empty servo-train is returned from the dispensing station to the loading station for reloading.

9. Apparatus as claimed in claim 1, characterised in that the or each servo-train comprises 2–20 buckets.

10. Apparatus as claimed in claim 1, wherein each bucket is adapted to receive 2–20 product units.

11. Apparatus as claimed in claim 1, wherein said second conveying means has continuous motion, and said controlling means are adapted to provide continuous movement of a loaded servo-train at the dispensing station in synchronisation with the second conveying means.

12. Apparatus as claimed in claim 1, wherein said second conveying means is adapted to move intermittently by advancing a batch comprising a predetermined number of cartons in each stroke, and said controlling means is adapted to provide corresponding synchronous intermittent motion of a loaded servo-train through the dispensing station.

13. A method of collating and cartonning product units comprising:

successively dispensing product units at a loading station;

conveying a servo-train comprising a plurality of buckets in which each bucket is configured to receive a predetermined plurality of product units past said product loading station with intermittent motion in synchronization with the dispensing of said product units such that said plurality of product units is received in each bucket to form a product group;

after loading of the servo-train is completed, conveying said servo-train to a dispensing station;

transporting a succession of cartons juxtaposed the servo-train at the dispensing station;

moving said servo-train through the dispensing station in synchronization with said transport of cartons; and pushing the product group from each bucket at the dispensing station into a single corresponding carton.

14. A method as claimed in claim 13, comprising providing a plurality of servo-trains and driving said servo-trains separately along the same path of travel and such that the servo-trains are moved successively through the loading and dispensing stations.

15. A method as claimed in claim 14, wherein two or three servo-trains are provided.

16. A method as claimed in claim 13, further comprising returning the or each servo-train to the loading station after emptying for reloading.

17. A method as claimed in claim 13, characterised by dispensing 2–20 product units into each bucket.

18. A method as claimed in claim 13, characterised in that the or each servo-train comprises 2–20 buckets.

* * * * *